US006474041B1

(12) United States Patent
Gambetti

(10) Patent No.: US 6,474,041 B1
(45) Date of Patent: Nov. 5, 2002

(54) MACHINE FOR PACKAGING OBJECTS BY MEANS OF A SHEET OF HEAT-SHRINK MATERIAL

(75) Inventor: Mario Gambetti, Crevalcore (IT)

(73) Assignee: Baumer S.R.L., Castelfranco Emilia (IT)

( * ) Notice: Subject to any disclaimer, the term of this patent is extended or adjusted under 35 U.S.C. 154(b) by 0 days.

(21) Appl. No.: 09/454,637

(22) Filed: Dec. 6, 1999

(30) Foreign Application Priority Data

Dec. 22, 1998 (IT) ..... BO98A0706

(51) Int. Cl.[7] ..... B65B 53/02

(52) U.S. Cl. ..... 53/141; 53/577; 53/589; 53/210

(58) Field of Search ..... 53/141, 389.4, 53/389.3, 589, 588, 210, 465, 557

(56) References Cited

U.S. PATENT DOCUMENTS 3,540,187 A * 11/1970 Monaghan ..... 53/210
4,051,643 A * 10/1977 Saito ..... 53/141

* cited by examiner

*Primary Examiner*—Stephen F. Gerrity
(74) *Attorney, Agent, or Firm*—Herbert Dubno

(57) ABSTRACT

A method for packaging objects by the use of heat-shrink material, in which there is wrapped in the manner of a sleeve around the objects, a sheet of heat-shrink material, heated to a temperature which is at least equivalent to the "defrosting" temperature of the material, a front portion and a rear portion of the sheet being disposed overlapping one another, in which the two portions are welded to one another, and in which the object-sheet assembly obtained is allowed to cool until the sheet shrinks onto the object.

23 Claims, 13 Drawing Sheets

1
2
3
3a
4
5
6
7
8
9
10
11
12
13
14
15
16
17
18a
18b
19a
19b
20a
20b
21
22
23
25
42
43
46
50
339
339a
340a
340b
340c
340d
340e
330
331
331a
331b
331c
331d
331e
338
341
342
342a
342b
342c
342d
342e
370
F1

MACHINE FOR PACKAGING OBJECTS BY MEANS OF A SHEET OF HEAT-SHRINK MATERIAL

FIELD OF THE INVENTION

The present invention relates to a method of packaging objects using sheets of heat-shrink material, and a corresponding packaging machine.

More particularly, the present invention is in the specific field of packaging objects such as boxes or batches of products (e.g. casks, cans, bottles, etc.) with sheets of heat-shrink material, in which individual sheets are wound in the form of a "sleeve" around corresponding objects to be packaged, in order then to heat-shrink the said sheets onto the corresponding objects, using the so-called phenomenon of "memory" ("resilient memory") with which specific plastics materials are provided, in order to consolidate the packaging.

BACKGROUND OF THE INVENTION

At present, see for example patents U.S. Pat. No. 5,203,144 U.S. Pat. No. 5,203,146, U.S. Pat. No. 5,463,846 and patent application IT-BO98A-000277 (corresponding to EP-99.105229.1 and U.S. Pat. No. 98.09/271,773—U.S. Pat. No. 6,128,888) in order to package objects with sheets of heat-shrink material (for example by means of shrinkable polyethylenes), firstly, a piece of heat-shrink material in sheet form is wound around an object in the form of a "sleeve", and subsequently, the object-piece assembly obtained, is conveyed by means of a belt conveyor into and through a tunnel oven of the convection type (e.g. with forced circulation of hot air), or of the radiation type (e.g. with infra-red lamps), which has an intake door and an output door, such as to heat the piece during passage inside the said tunnel, to a specific temperature, which varies in relation to the type of shrinkable material, such as to weld to one another the head portion to the tail portion of the piece, which overlap one another and are disposed beneath the object, in order then, after output from the tunnel oven, during cooling, to shrink the said piece onto the object, as a result of the above-described phenomenon of "memory", and consequently to consolidate the packaging.

This method and the corresponding machines have a series of disadvantages.

A first disadvantage is caused by the fact that an enormous amount of energy is consumed by the said tunnel oven, inside which there must be formed and maintained during operation, forced air circulation at an indicative temperature of approximately 200–250°, such as to heat the piece of heat-shrink material in sheet form, to an indicative temperature of 110–130° C. in acceptable times, i.e. during the period of time which the object-piece assembly takes to travel from upstream to downstream of the tunnel itself.

In addition, in relation to the above-described disadvantage, it must be emphasised that during operation, the intake door and the output door of the tunnel oven open periodically, in order to permit intake and output of the object-piece assemblies, with consequent dispersion of some kilocalories produced, and thus with a relatively large consumption of energy for production of the said dispersed kilocalories.

A second disadvantage is caused by the fact that some of the kilocalories produced are absorbed by the conveyor which transports the object-piece assemblies, with consequent energy consumption for production of new kilocalories designed to compensate for the said absorption.

A third disadvantage is owing to the fact that a further portion of the kilocalories produced is absorbed by the object wrapped, with consequent energy consumption for the production of new calories designed to compensate for the said absorption.

In addition, in relation to the above-described disadvantage, it must be emphasized that these methods and these devices can be used only to package objects and/or products which, without deteriorating and/or being damaged, can undergo the heating which takes place inside this tunnel oven, i.e. in other words, these methods and these devices cannot under any circumstances be used to package objects and/or products which are degradable in heat and/or heat-sensitive, or inflammable products.

SUMMARY OF THE INVENTION

The invention solves the above-mentioned problems by providing a method characterized in that it provides the use of a sheet of heat-shrink material which is heated to a temperature which is at least equivalent to its "defrosting" temperature, in that the said heated sheet is wrapped around an object to be packaged in the manner of a sleeve with a front portion and a rear portion of the said sheet overlapping one another, in that the said front portion is welded to the said rear portion of the sheet; and in that the assembly obtained is allowed to cool until the sheet shrinks onto the object.

In addition, according to one of its variants, the same invention solves the problem of creating a further correlated method for packaging objects by means of sheets of material, which are wrapped in the manner of a sleeve around the objects and shrunk onto the latter, in which the said method is characterized in that it provides the use of a sheet of heat-shrink material heated in a differentiated manner, in which some areas of the sheet are heated at a different temperature from other areas of the same sheet, and in which the arrangement of these areas is selected in relation to the position which the areas themselves assume relative to the object to be packaged, when the said sheet thus heated is wrapped accordingly around the object to be packaged; in that the said sheet of heat-shrink material heated in a differentiated manner is wrapped around the object to be packaged in the form of a sleeve with a front portion and a rear portion of the said sheet overlapping one another; in that the said front portion is welded to the said rear portion of the sheet, and in that the assembly obtained is allowed to cool until different percentages of heat shrinkage are obtained amongst the said areas previously heated in a differentiated manner.

In addition, the same invention also solves the problem of creating a machine for packaging objects by means of sheets of heat-shrink material obtained from a continuous tape of heat-shrink material, which are wrapped in the manner of a sleeve around the objects and shrunk onto the objects themselves, in which the said machine comprises: first conveyor means, which are disposed upstream and can translate and supply the objects longitudinally along a transport plane; second conveyor means, which are disposed downstream and are slightly spaced relative to the said first conveyor means, giving rise to a first aperture between the said first and the said second conveyor means, which can receive the objects presented by the said first conveyor means and translate them longitudinally along a second wrapping plane, which has an intake end and an output end; third conveyor means, which are disposed downstream and slightly spaced relative to the said second conveyor means, giving rise to a second aperture between the said second and the said third conveyor means, which can receive the objects presented by the said second conveyor means, and translate them longitudinally along a transport plane; wrapping means, which are disposed in the vicinity of the said second conveyor means, including suspended wrapping bars, which are oriented transversely relative to the direction of longitudinal advance of the object, and are translated through the said first and the said second aperture, along an orbital path which circumscribes the second conveyor means, and can transport the sheets of packaging material, for wrapping around the objects to be packaged; supply means, which are disposed beneath and aligned in the vicinity of the said first aperture, and can supply a tape of packaging material; cutting means, which are disposed between the supply means and the said first aperture, and can cut the tape of packaging material transversely; and synchronisation means, which can synchronise the said conveyors and the said operative means with one another; in which the said machine is characterised in that it comprises heating means which are disposed upstream from the said wrapping means in order to heat a cold tape of packaging material to a temperature which is at least equivalent to its "defrosting" temperature.

By means of use of the method and the machine, which is the subject of the present invention, the following results are obtained: the tunnel oven is eliminated; and the objects to be packaged are not heated.

The advantages obtained by means of a the present invention consist, substantially, in that there is a reduction of the overall cost of the packaging machine, in that there is an enormous reduction of the energy consumed in order to carry out the packaging, in that a regular shrinkage of the packaging sheet is obtained, and in that even objects and/or products which are heat-sensitive can be packaged with heat-shrink material in sheet form.

In addition, with reference to the variant embodiments of the operative method which is the subject of the present invention, and the variant embodiments of the packaging machine which is also the subject of the present invention, in addition to the above-described results, the result is obtained of heating a sheet of packaging material in a differentiated manner, in which some areas of the said sheet are heated at different temperatures from the others.

The advantages obtained by means of the said variants substantially consist in the fact that it is possible to optimise and pre-select the areas of heat-shrinkage of the sheet, in order to obtain cooled packaging which is heat shrunk only in specific areas and not in other areas, as well as packaging which has different required percentages of heat shrinkage in different specific areas, in which the said areas and the said percentages of heat shrinkage are selected in relation to the type or shape of the object to be packaged.

BRIEF DESCRIPTION OF THE DRAWINGS

Further characteristics and advantages of the present invention will become more apparent from the following detailed description of some preferred practical embodiments, provided purely by way of non-limiting example, with reference to the Figures of the attached drawings, in which.

DESCRIPTION OF THE PREFERRED EMBODIMENT

With reference to the following description, it should firstly be noted that the films of heat-shrink packaging material in sheet form, such as PVC, heat-shrink polyethylenes, LDPEs, etc, have a stretched and frozen molecular structure, such that, if the said films are heated at least to a temperature at which the molecules acquire a specific level of freedom, which is defined here as the "defrosting" temperature, during the cooling stage, as a result of the so-called phenomenon of "memory" or "resilient memory", the said molecules tend to assume their original orientation, with consequent heat-shrinkage of the film itself.

In addition, in the case of specific heat-shrink films, the percentile value of the heat-shrinkage depends on the value of the heating temperature, and consequently, the said heating temperature of the film is selected by the user in relation to the percentage of the heat shrinkage to be obtained.

Figure 1:
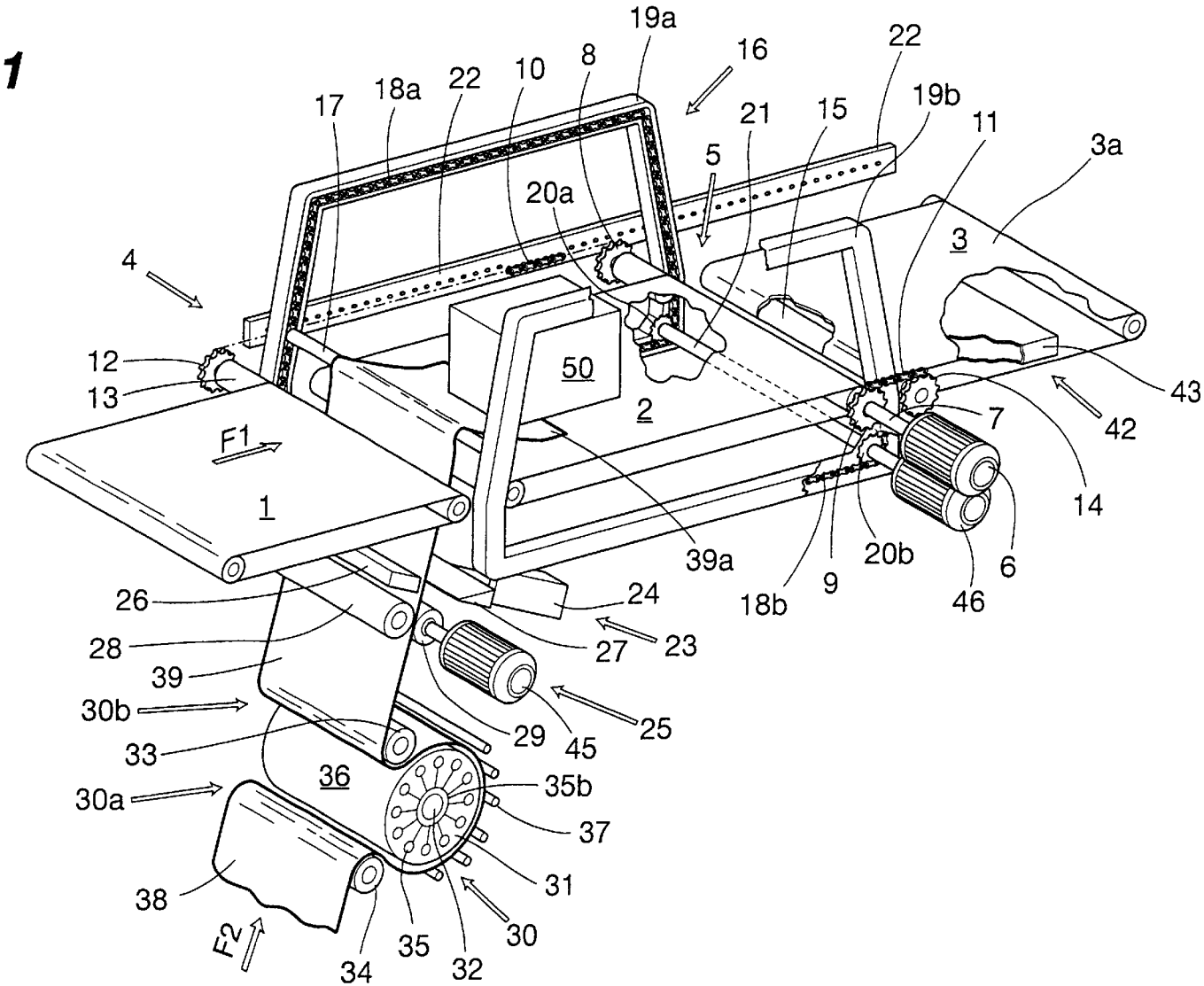
FIG. 1 is a schematic perspective view of the packaging machine which is the subject of the present invention, according to a first practical embodiment.

With reference to FIG. 1, the packaging machine which is the subject of the present invention comprises three conveyors, indicated as 1, 2 and 3, which are disposed in series one after another, and are slightly spaced longitudinally from one another, in order to define a first aperture 4 between the conveyors 1 and 2, and a second aperture 5 between the conveyors 2 and 3.

A first servomotor 6, of an electric type, actuates a shaft-roller 7, around which the second conveyor 2 is wound. At its opposite ends, the said shaft-roller 7 has keyed onto it two respective crown wheel, indicated as 8 and 9, around which there are wound respective chains 10 and 11, such that the first chain, indicated as 10, is wound onto a crown wheel 12, keyed onto a shaft-roller 13, around which the first conveyor 1 is wound, and the second chain, indicated at 11, is wound around a crown wheel 14, keyed onto a shaft-roller 15, around which the third conveyor 3 is wound.

The second conveyor 2 or winding conveyor, is associated with wrapping means, indicated as 16 as a whole, which substantially consist of transverse wrapping bars 17, which orbit around the said second conveyor 2, passing through the said first aperture 4 and the said second aperture 5, wherein the bars 17 themselves have their own opposite ends supported by two respective chains 18*a* and 18*b*, which are disposed facing one another, and are wound in respective parallel planes which extend longitudinally and vertically, and are disposed respectively on the two longitudinal sides of the second conveyor 2 itself, wherein the said chains 18*a* and 18*b* are designed to slide inside guide grooves provided by respective frames which are indicated as 19*a* and 19*b*, and are illustrated schematically in this case.

The chains 18*a* and 18*b* are actuated by means of a pair of sprockets 20*a* and 20*b*, keyed onto the opposite ends of a single shaft 21, which in turn is actuated by a second servomotor 46, which is also of the electrical type.

Along one side of the conveyor 2, at a height equivalent to that at which the objects to be packaged 50 are conveyed, there is disposed a position sensor 22, for example of the opto-electronic type, which extends longitudinally until it meets the transport section configured by the conveyors 2 and 3.

In the area beneath the conveyor 2, in the vicinity of its intake end, there are disposed means for supplying the packaging material, which include cutting means, which are indicated as 23 as a whole, and, disposed further upstream in relation to the direction of supply of a continuous tape 38–39, there are disposed the supply means 25.

The cutting means 23 substantially comprise a counter-blade 26 and a blade 27, which extend transversely relative to the tape 39, in which the blade 23 is actuated by an actuator 24 of the electromagnetic type and/or pneumatic type and/or of a known type. These cutting means 25 can also be of the rotary blade type.

The supply means 25 substantially comprise a pair of rollers 28 and 29, which are preferably rubberised with particular material, between which the continuous tape 39 is engaged, wherein the roller 29 is actuated by a third servomotor 45, which is also of the electrical type.

Upstream from the said supply means 25, there are disposed heating means, which are indicated as 30 as a whole, and are designed to heat the cold tape 38 which enters cold in the vicinity of the upstream end 30*a* of the said heating means 30, and is then output heated, as described in greater detail hereinafter, in the vicinity of the downstream end 30*b* of the heating means 30 themselves.

The heating means 30 comprise a heating drum 31, which is supported by a shaft 32, and two return rollers 33 and 34, wherein the said drum 31 and the said rollers 33 and 34 are oriented transversely relative to the direction F2 of travel of the tape 38–39.

By way of example, the aforementioned heating drum 31 can be produced by means of a plurality of thermostatic, resistor-type heaters 35, which are accommodated in axial holes provided in the vicinity of the shell 36 of the drum 31 itself, with an equidistant circumferential arrangement, wherein the said heaters 35 are interconnected and are supplied by means of sliding contacts 35*b* disposed on the sides of the drum 31, in order to be able to power supply the said resistors whilst the drum 31 is rotating.

During functioning of the machine, as described in greater detail hereinafter, the said heater drum 31 heats by means of thermal conduction the cold tape 38 of heat-shrink material which is wound onto the shell 36, in order then to supply to the supply means 25, the cutting means 23 and the wrapping means 16, a heated tape 39 of heat-shrink material, the temperature of which is at least equivalent to the said temperature of "defrosting", or to a higher temperature, as described in greater detail hereinafter.

If required, in order to improve the heating of the tape 38, the heating means 30 can also include a plurality of pressure rollers 37, which are designed to keep the cold tape 38 pressed against the shell 36 of the said drum 31, and also, again if required, the said pressure rollers 37 can be hot, such as to heat also the other surface of the tape 38, and thus heat the tape 38 itself by means of thermal propagation, by conduction, by acting on both surfaces of the tape.

Again with reference to the heating means 30, and also if required, it is also possible to make the return roller 34 hot, or to make the return roller 33 hot, or to make both these rollers 34 and 33 hot, again in order to heat the other surface of the tape 38, and thus to increment the propagation of heat towards the cold tape 38 by thermal conduction, by acting on both its surfaces.

Upstream from the said heating means 30 there are disposed devices to control the unwinding of the continuous cold tape 38 from the respective bobbin, which devices are not described and illustrated here, since they are beyond the scope of the present invention, and are known to persons skilled in the art.

Optionally, if required, the third conveyor 3 can have heating-welding means 42, which, by way of example, can consist of a conveyor belt 3*a*, which is wound in a closed path, and is made of flexible, anti-adhesive and heatable material, such as glass-silicon and/or teflon glass and/or similar materials, in which the upper section of the said path is in contact with a heating element 43 beneath, for example an electrical resistance heater and/or an irradiation heater and/or a convection heater, which is designed to heat at least the upper section of the said conveyor belt 3*a*, for the reasons which will become apparent hereinafter.

In addition, the said machine is also provided with a control system (electrical, mechanical, electronic), in order to actuate in phase ratio the various servomotors, actuators and transducers of an electrical/electronic system, such as to vary and regulate the temperature of the resistors 35, and thus the temperature of the shell 36 of the heating drum 31, as well as, optionally, if required, of similar electrical/electronic systems, in order to vary and regulate the temperature of the pressure rollers 371 the temperature of the first return roller 34, and the temperature of the second return roller 33; wherein the temperature of each and/or all of the said elements 36, 37, 34 and 33 is selected in accordance with the type of heat-shrink material used, in relation with the thickness of the latter, and in relation with the speed of advance of the tape 38–39, since this last variable determines the heating time of the cold material 38 by thermal conduction, as will become more apparent hereinafter.

With reference to the optional heating-welding means 42, the said machine is also provided with an electrical/electronic system in order to vary and regulate the temperature of these means, and more particularly the heating element 42.

With reference to the drum 31, it should be noted that the system for obtaining heating of its shell 36 can also be implemented by means of other heating systems (dielectric, by induction, circulation of hot fluid etc), which are designed to heat the said shell 36, and keep it hot whilst the drum 31 rotates.

With reference to FIGS. 2 to 10, the objects 50*a*, 50*b* and 50*c* are supplied in individual succession from upstream in the downstream direction of the machine, with a direction of advance F1, with longitudinal translation of the objects along the conveyors 1, 2 and 3.

Figure 2:
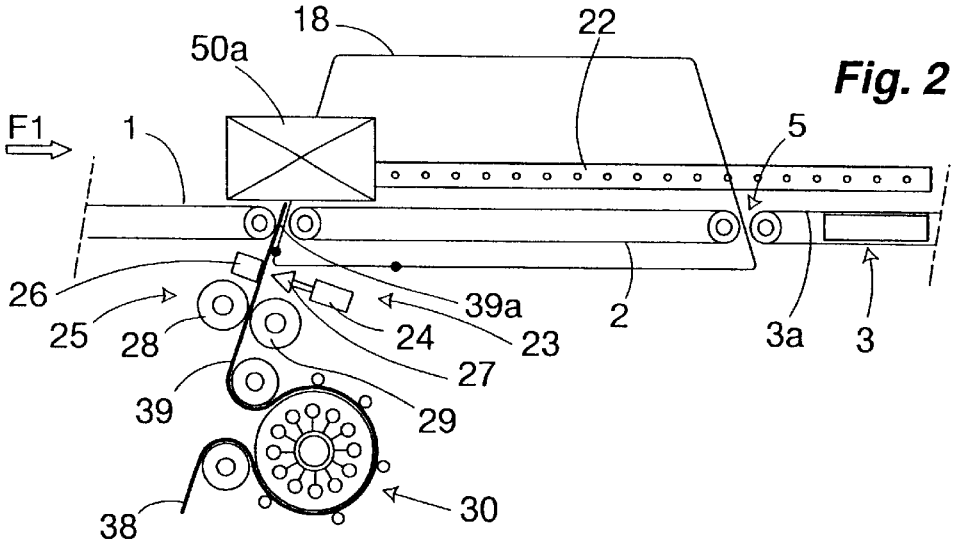
FIGS. 2 to 10 are schematic lateral views which are designed to illustrate the operative method which is the subject of the present invention, implemented in conformity with the machine in FIG. 1.

With reference to FIG. 2, an object 50*a* from the first conveyor 1 is translated onto the second conveyor 2, whereas a front portion 39*a* of tape 39, which has previously been heated at least to its "defrosting" temperature or to a higher temperature, by means of the heating means 30 as described in greater detail hereinafter, is being supplied to the initial end of the second conveyor 2.

Figure 3:
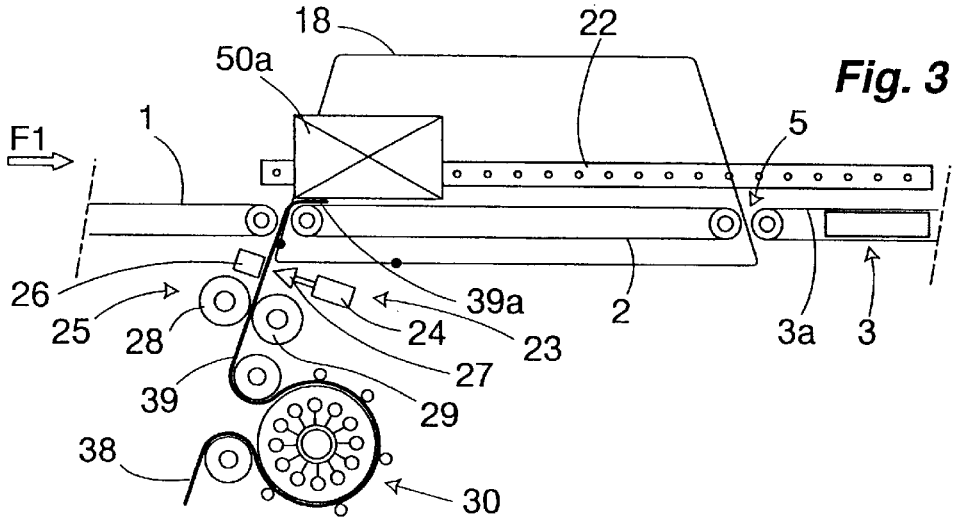

With reference to FIG. 3, when the object 50*a* reaches the position between the first conveyor 1 and the second conveyor 2, the supply means 23, which consist of the rollers 28 and 29, supply the heated tape 39 towards the conveyor 2, such that the said front portion 39*a* is disposed between the second conveyor 2 and the object 50*a* which is advancing, and during this operation, upstream in relation to the direction of advance of the tape 39–38, the heating means 30 heat the cold tape 38 which is disposed inside the said heating means 30, and subsequently heat the tape 38 which advances inside the said heating means 30, during the successive wrapping steps described hereinafter.

Figure 4:
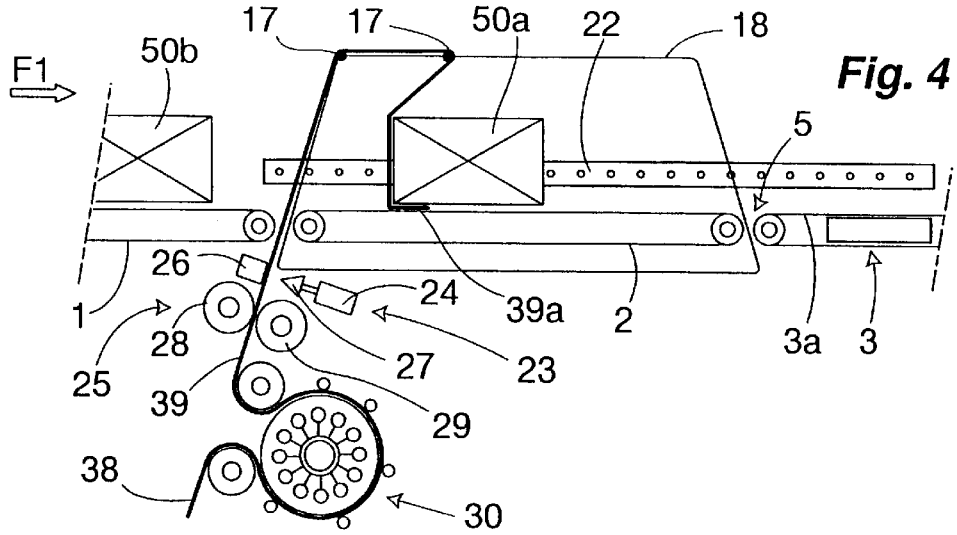

With reference to FIG. 4, the object 50*a* has advanced downstream, with the front portion 39*a* of the heated tape 39 interposed between the base of the object 50*a* and the transport plane of the conveyor 2, and upwards the transverse wrapping bars 17 of the wrapping means 16 have brought a portion of heated tape 39 above the object 50*a*.

Figure 5:
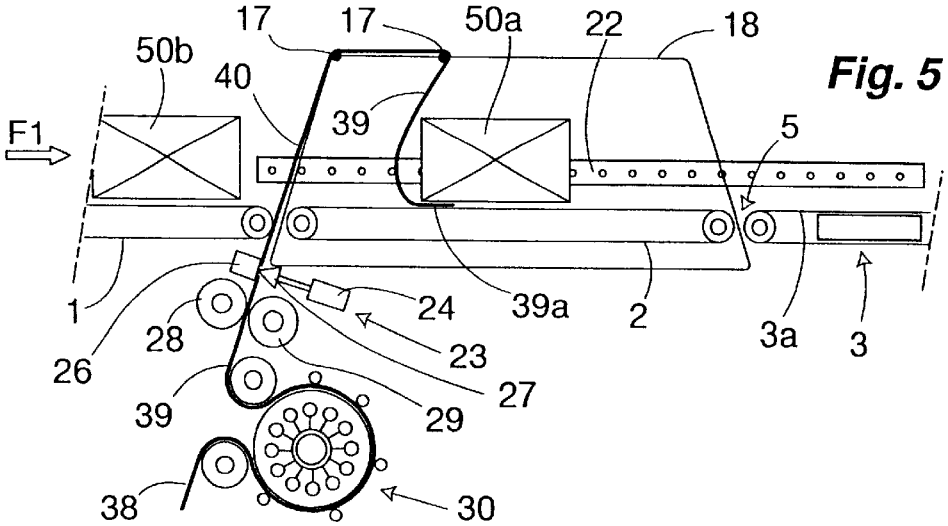

With reference to FIG. 5, when the transverse bars 17 reach a specific position of their path of longitudinal advance in the downstream direction, in which a required length of heated tape 39 has been extracted, the actuator 24 brings the blade 23 against the counter-blade 26, in order to cut off the tape 39, thus providing a sheet 40 of heat-shrink material, which is heated at least to the "defrosting" temperature, or to a higher temperature.

Figure 6:
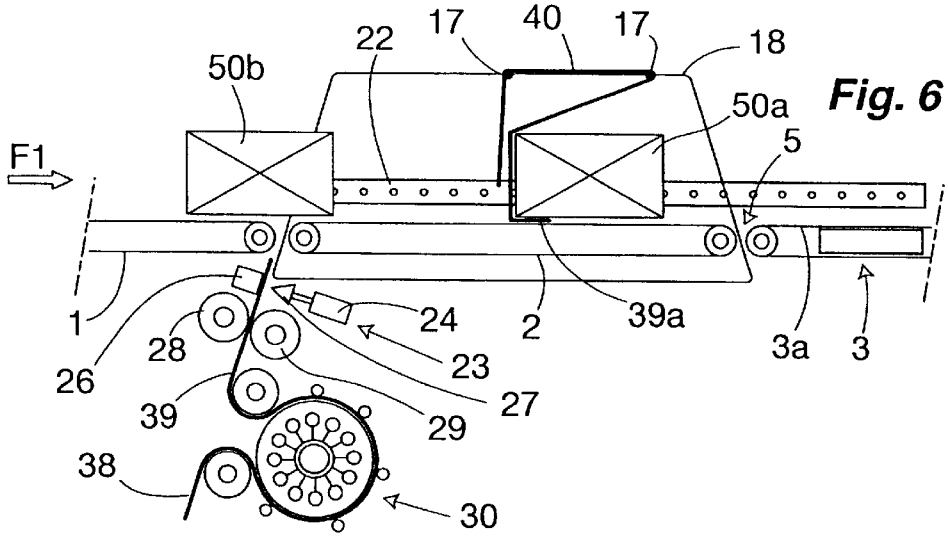
Figure 7:
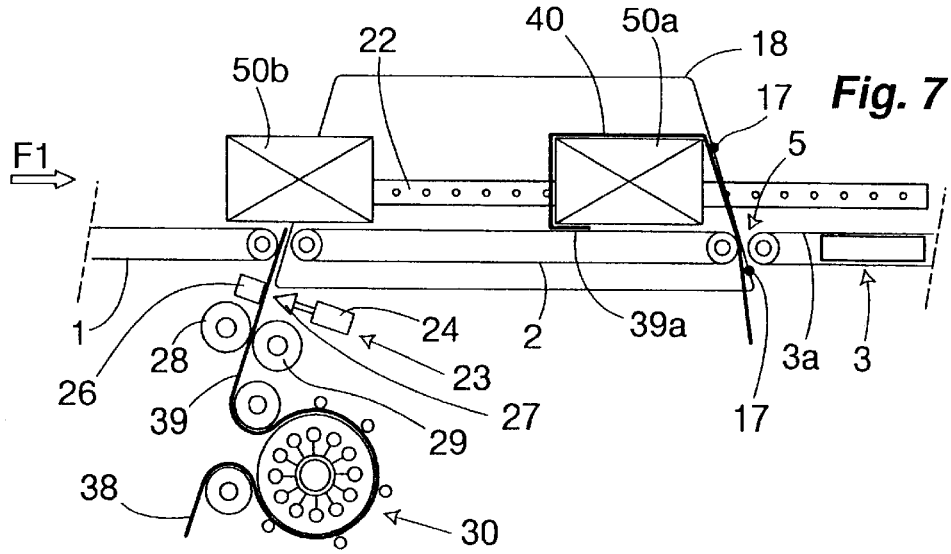
Figure 8:
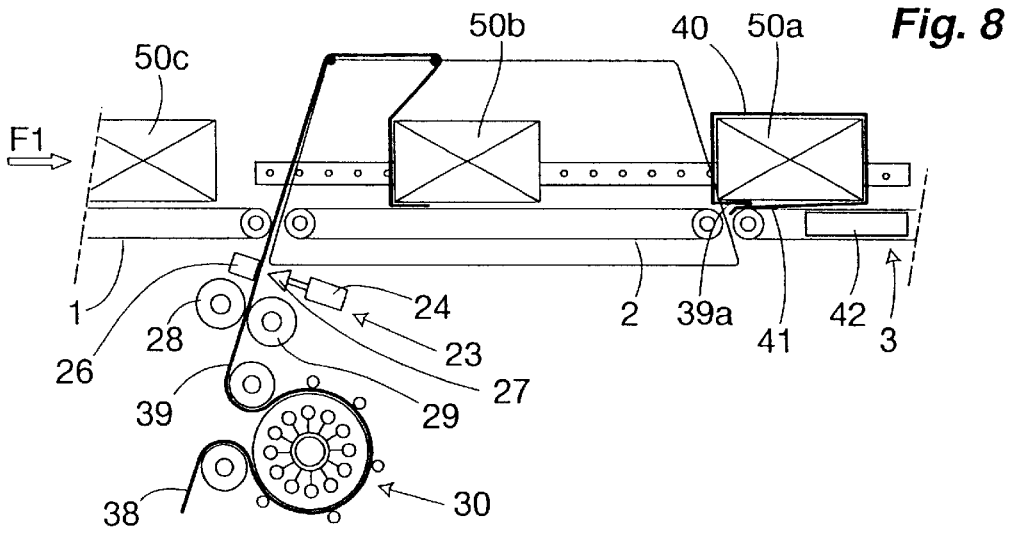

With reference to FIGS. 6, 7 and 8, the heated sheet 40 thus obtained is wrapped around the object 50*a*, and when the object-sheet assembly 50*a*–40 obtained passes onto the third conveyor 3, the final portion 41 of the said sheet 40 is folded beneath the front portion 39*a* of the sheet 40 itself, see in particular FIG. 8.

Figure 9:
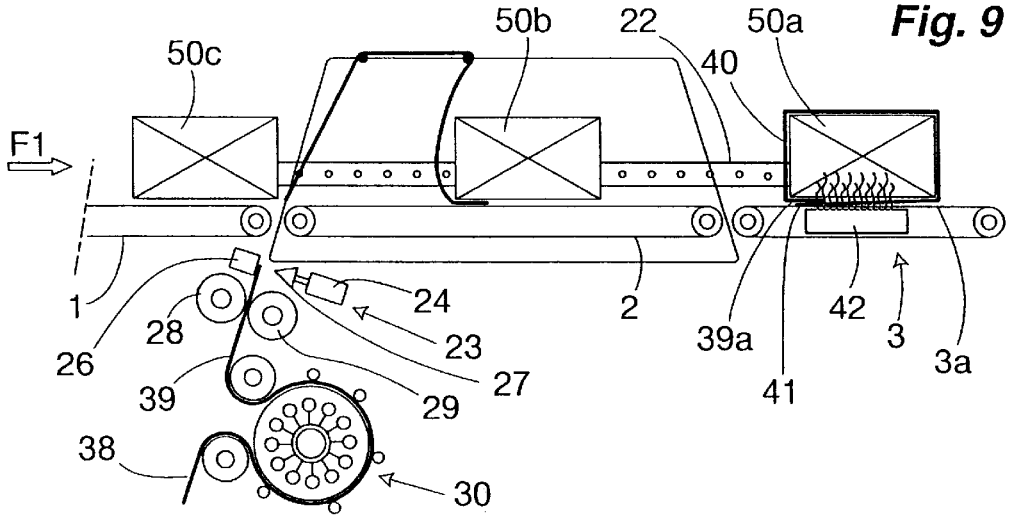

With reference to FIG. 9, the assembly obtained of the object 50*a* and sheet 40 is translated onto the third conveyor 3, and advanced in the downstream direction, and, optionally, when the said two end portions 39*a* and 41 which are overlapping one another and are pressed onto one another reach the vicinity of the heating means 42 which heat the conveyor 3*a*, welding takes place between the two end portions 39*a* and 41 of the sheet 40.

Figure 10:
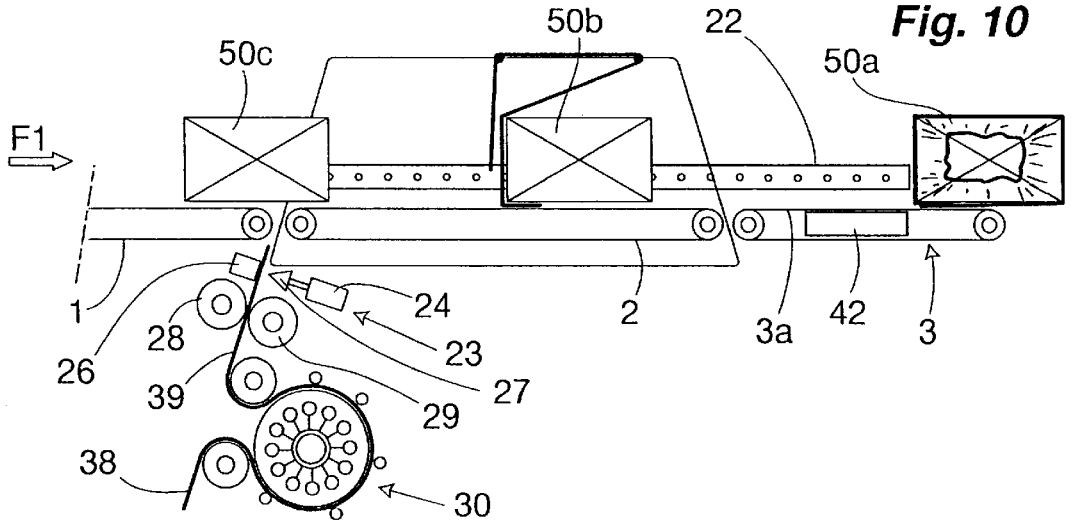

Then, see FIG. 10, the sheet 40 which is thus wrapped around the object 50*a*, with the end portions 39*a* and 41 welded to one another, is allowed to cool, with consequent heat shrinkage of the sheet 40 itself, and consolidation of the packaging.

Whilst the above-described operations are taking place, with reference to the object 50*a*, again see FIGS. 2 to 10, upstream from the object 50*a* itself other successive objects 50*b* and 50*c* are gradually being packaged in the manner previously described.

The heating-welding means 42 which are designed to weld the end portions 39*a* and 41 of the sheet 40 can be eliminated if specific heat-shrink materials and/or specific thicknesses are used, since it is possible to obtain self-welding between the said portions 39*a* and 41, including by means of simple reciprocal overlapping with pressing, wherein the latter depends on the weight of the object 50 to be packaged. In order to obtain this effect, the cold tape 38 of material in sheet form can sometimes be heated, again by means of the heating means 30, to a temperature higher than that of "defrosting", i.e. to a temperature such as to render the portions 39*a* and 41 self-welding, when they are overlapping one another and are pressed (compressed) beneath the object.

Longitudinal Stretching

With reference to the operative method and to the above-described preferred practical embodiment, if it is necessary or appropriate, it is possible to carry out longitudinal stretching of the heated tape 39 before cutting off the sheet 40 and wrapping it around the object 50*a*.

In order to obtain longitudinal stretching of this type, for example, again see the embodiment of the machine illustrated in FIG. 1, for the heating drum 31 a peripheral speed is adopted which is lower than that of the drive rollers 28 and 29, with consequent longitudinal stretching of the heated tape 39.

Transverse Stretching

Figure 11:
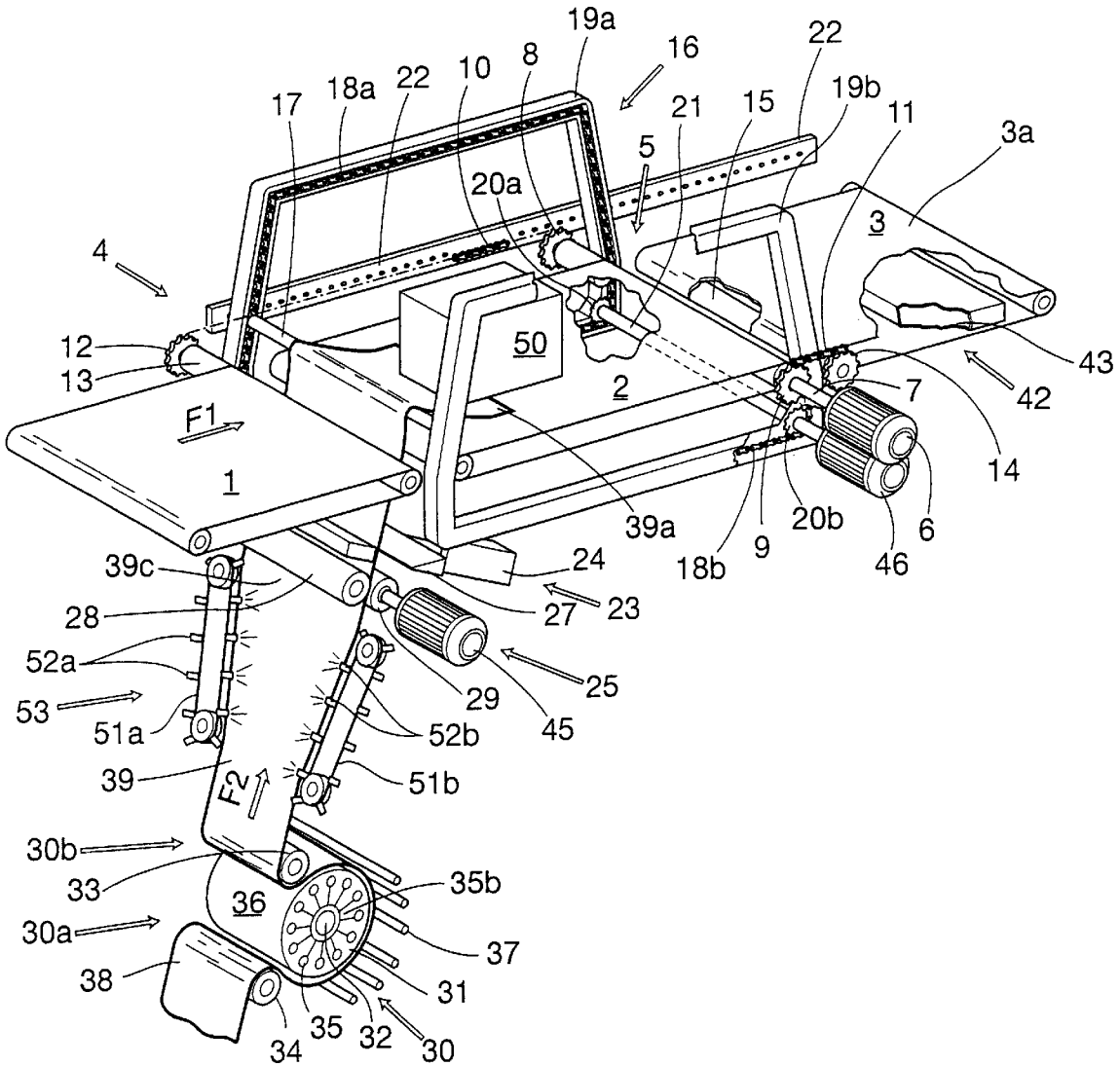
FIG. 11 is a schematic perspective view of the packaging machine which is the subject of the present invention, similar to FIG. 1, but provided with a further particular device.

With reference to FIG. 11, which illustrates a second practical embodiment of the machine and method which are the subject of the present invention, between the supply means 25 and the heating means 30 there are disposed means for transverse stretching indicated as 53.

More particularly, the said means 53 for transverse stretching are of the so-called "rameuse" type, in which two chains or belts 51*a* and 51*b*, which are disposed at the longitudinal sides of the tape 39 and diverge in the downstream direction, are provided with respective pluralities of clamps 52*a* and 52*b* which are designed to grasp respectively the two transverse ends of the heated tape 39, after it has been output from the heating means 30, in order then to stretch it transversely whilst it is moving in the downstream direction, and thus to present to the supply means 23 a tape 39*c* which is stretched transversely.

First Variant Embodiment—Means for Heating by Irradiation

Figures 12, 12A:
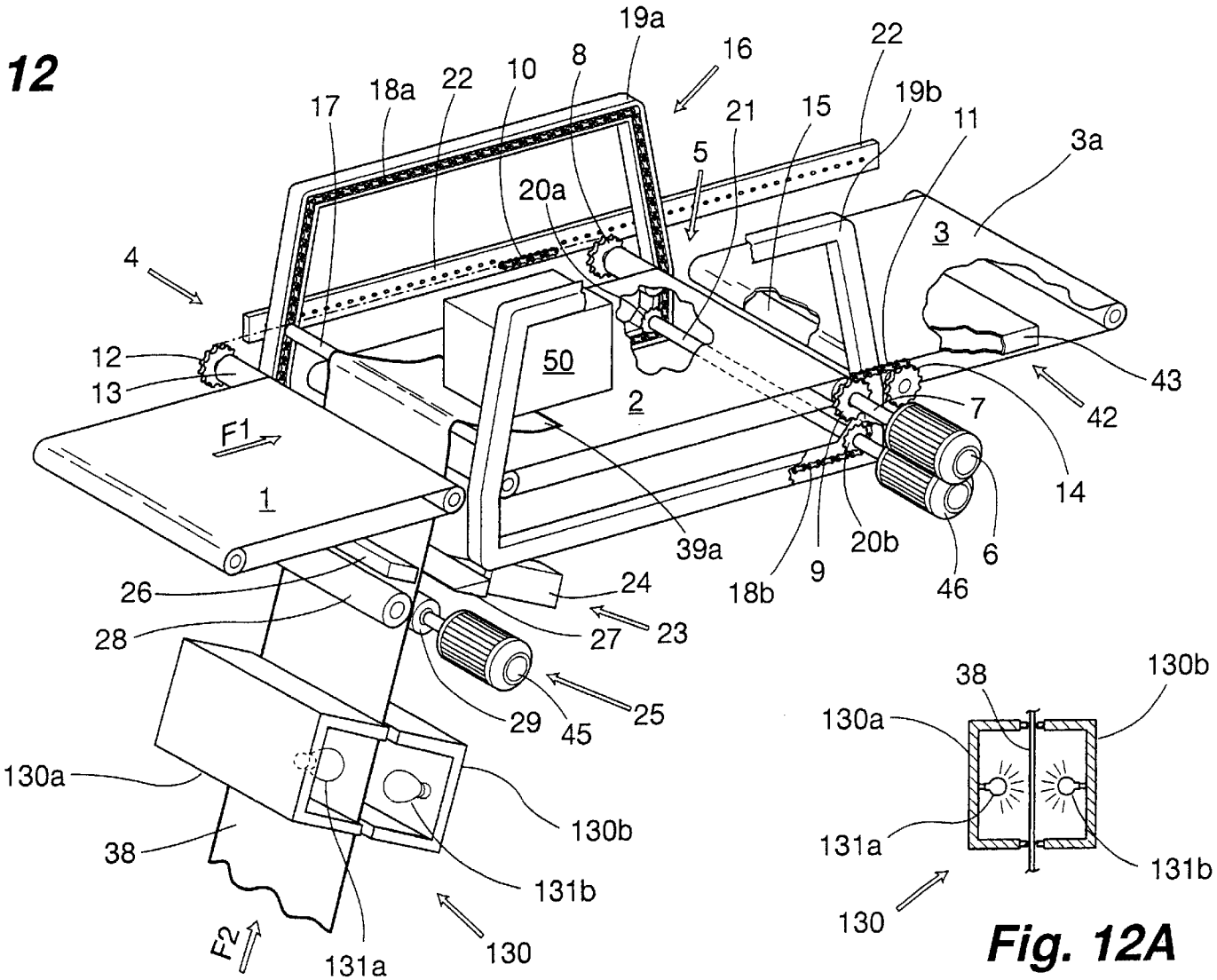
FIGS. 12 and 12A are schematic perspective views of the machine which is the subject of the present invention, similar to FIG. 1, but provided with different operative means.

FIGS. 12 and 12A illustrate a different embodiment of the machine which is the subject of the present invention, in which the heating means 130 are designed to heat the tape 38 by means of thermal irradiation.

More particularly, in this embodiment, the heating means 130 consist of two supports 130*a* and 130*b*, which are hollow internally, have a transverse length equivalent to that of the cold tape 38, and are designed to support respective pluralities of irradiating lamps, for example infra-red lamps 131*a*, 131*b*, which are disposed facing one another, between which the cold tape 38 moves freely, in order to be able to heat the tape by irradiation whilst it is advancing in the downstream direction.

Second Variant Embodiment—Means for Heating by Convection

Figures 13, 13A:
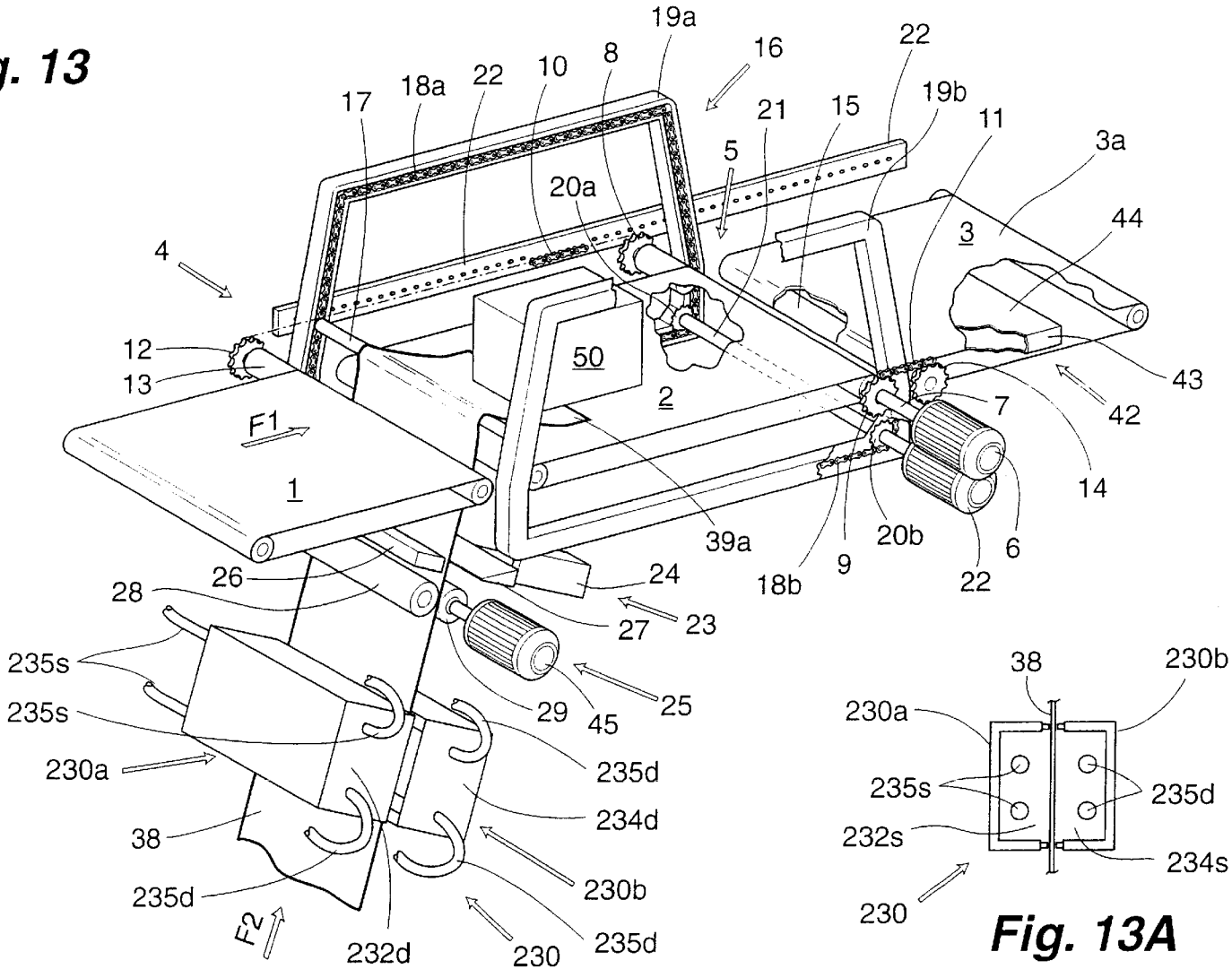
FIGS. 13 and 13A are schematic perspective views of the machine which is the subject of the present invention, similar to FIG. 1, but provided with different operative means.

FIGS. 13 and 13A illustrate a different embodiment of the machine which is the subject of the present invention, in which, schematically, heating means 230 are designed to heat the tape 38 by means of thermal convection.

More particularly, in this embodiment, the heating means 230 consist of two cases 230*a* and 230*b* which are hollow internally, have a transverse cross-section in the shape of a "C", are disposed facing one anther, and have a length equivalent to the length of the cold tape 38.

The opposite transverse end sides of the said two cases, the end sides 232*s*–232*d* of the case 230*a*, and the end sides 234*s*–234*d* of the case 230*b* support ducts, indicated as 235*s* and 235*d*, which are connected in a closed circuit to an air heater, not shown, in order to create forced circulation of hot air inside the chambers of the said two cases 230*a* and 230*b*.

Thus, the tape 38 which moves freely between the said two hollow cases 230*a* and 230*b* is heated by the circulating forced hot air, and is thus heated to the required temperature.

Third Variant Embodiment—Longitudinal Strips Heater

Figure 14:
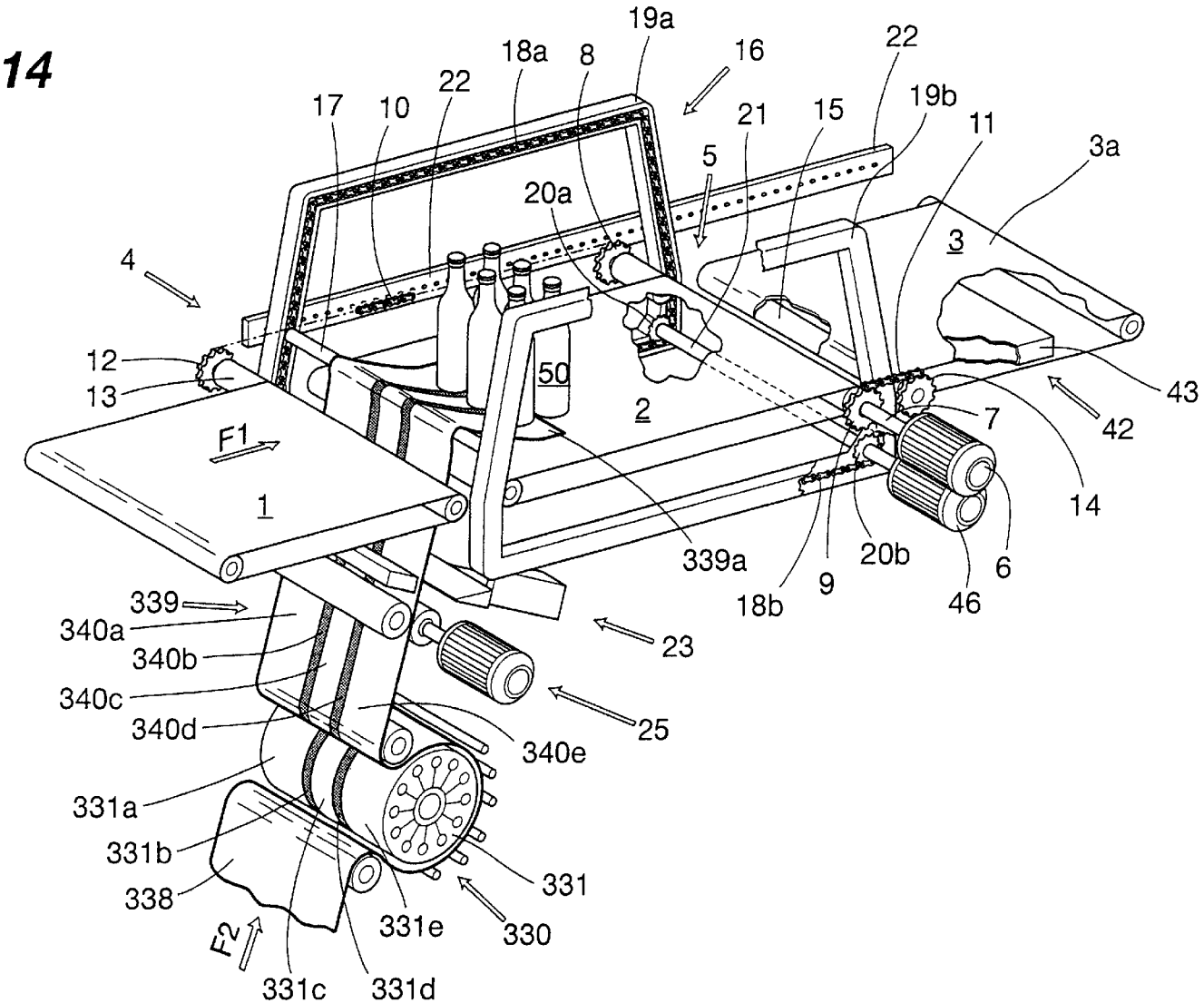
FIGS. 14, 14A, 14B, 14C and 14D are schematic views which are designed to illustrate a variant of the method and the machine which are the subject of the present invention.
Figure 14A:
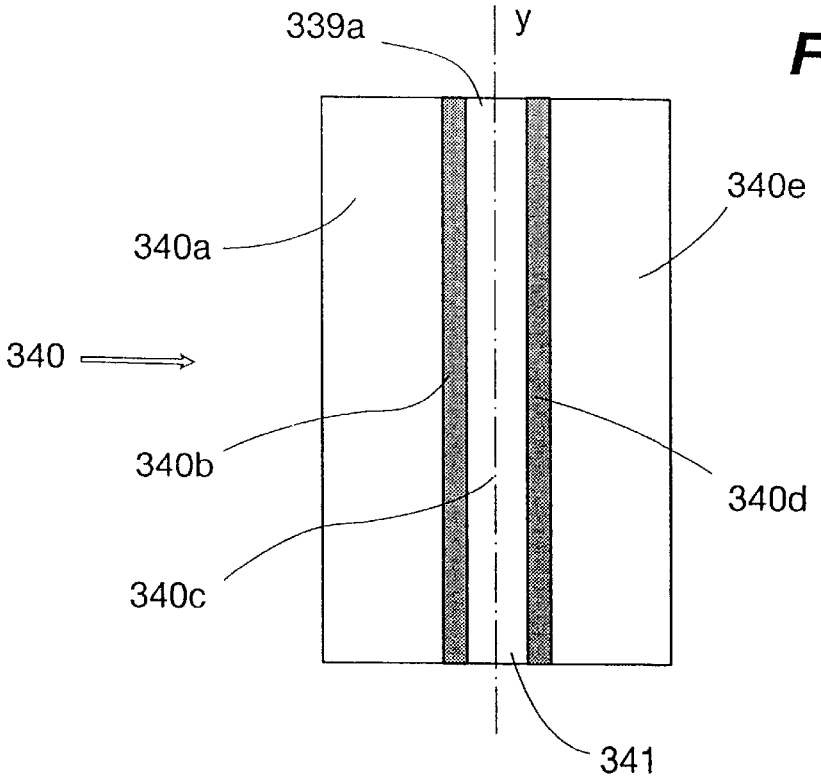
Figure 14B:
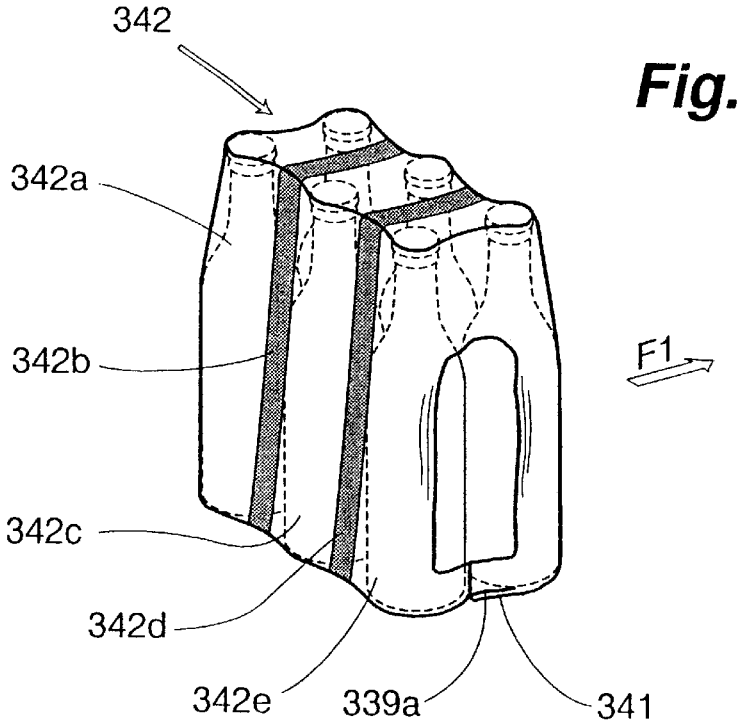

FIGS. 14, 14A and 14B illustrate a different embodiment of the above-described method and machine, which are the subject of the present invention.

Substantially, with reference to this variant, from a heated tape 339 of heat-shrink material, which is heated in a manner described in greater detail hereinafter, there is obtained a sheet 340 which extends along a longitudinal supply and wrapping axis indicated as "Y", which has first longitudinal strips 340*b*, 340*d* heated to a first, higher temperature, and second longitudinal strips 340*a*, 340*c* and 340*e* heated to a second, lower temperature.

The said first and second heating temperatures are thus different from one another, but higher than the "defrosting" temperature, such that, after the said heated sheet 340 has been wrapped in the manner of a "sleeve", and is in the correct position around an object, after welding to one another has taken place of the reciprocally overlapping front portion 339*a* and the rear portion 341, and after the said wrapped sheet 340 has been allowed to cool, see in particular FIG. 14B, a heat-shrunk packaging 342 is obtained, which has first longitudinal strips 342*b* and 342*d* which correspond to the original first longitudinal strips 340*b* and 340*d*, and are considerably heat-shrunk, i.e. which have substantial accumulation of material, and second longitudinal strips 342*a*, 342*c*, 342*e*, corresponding to the original longitudinal strips 340*a*, 340*c* and 340, which are slightly heat-shrunk, i.e. which have a low accumulation of material.

In addition, if required, on the cooled packaging 342, it is also possible to obtain the said longitudinal strips 342*a*, 342*c*, 342*e*, free from heat-shrinkage, by using an operative method which does not involve heating the corresponding longitudinal strips 340*a*, 340*c*, 340*e* of the sheet 340, or which involves heating the said strips 340*a*, 340*c* and 340*d* to a temperature lower than the so-called "defrosting" temperature.

In order to implement this variant method, by way of example, see FIG. 14, the corresponding machine is provided with different heating means, in this case indicated as 330, which include a specific heating drum, indicated as 331, formed from a plurality of cylinders 331*a*, 331*b*, 331*c*, 331*d*, 431*e*, which are heated individually, disposed adjacent to one another axially, and separated from one another by a thermal insulating material, wherein the cylinders 331*b* and 331*d* are heated to a higher temperature than the cylinders 331*a*, 331*c* and 331*e*, such that when the cold tape 338 is wound onto the shell formed by the drum 331 in sections 331*a*, 331*b*, 331*c*, 331*d*, 331*e*, is heated by thermal conduction, in the above-described differentiated manner.

This specific embodiment, for example, see again FIG. 14*b*, can advantageously be used in packaging of objects such a bottles or similar products, in which the strips 340*b* and 340*d* which are heated most, provided on the tape 339, and thus on the corresponding sheet 340, are correctly disposed and spaced transversely such as to be provided on the corresponding batch of bottles, in the vicinity of the areas of separation between the longitudinal rows of the bottles themselves, in order, after the conventional operations of wrapping and heat shrinking, to obtain cooled packaging 342, which in the areas 342*b* and 342*d* has considerable accumulation of material, with considerable shrinkage, and thus little transparency, and, simultaneously, in the areas 342*a*, 342*c* and 342*e*, minimal accumulation of material, with consequent good transparency.

By this means, the packaging 342 thus obtained has a more pleasing external appearance, and, simultaneously, a potential purchaser who looks at the said packaging can distinguish more clearly the bottles it contains, since the said strips 342*a*, 342*c*, 342*e*, i.e. the ones which are more transparent, are disposed against the shafts of the said bottles. In addition, in this context, it should also be pointed out that any labels which are applied to the shafts of the bottles, and which are correctly oriented towards the exterior before packaging takes place, are more intelligible.

Figures 14C, 14D:
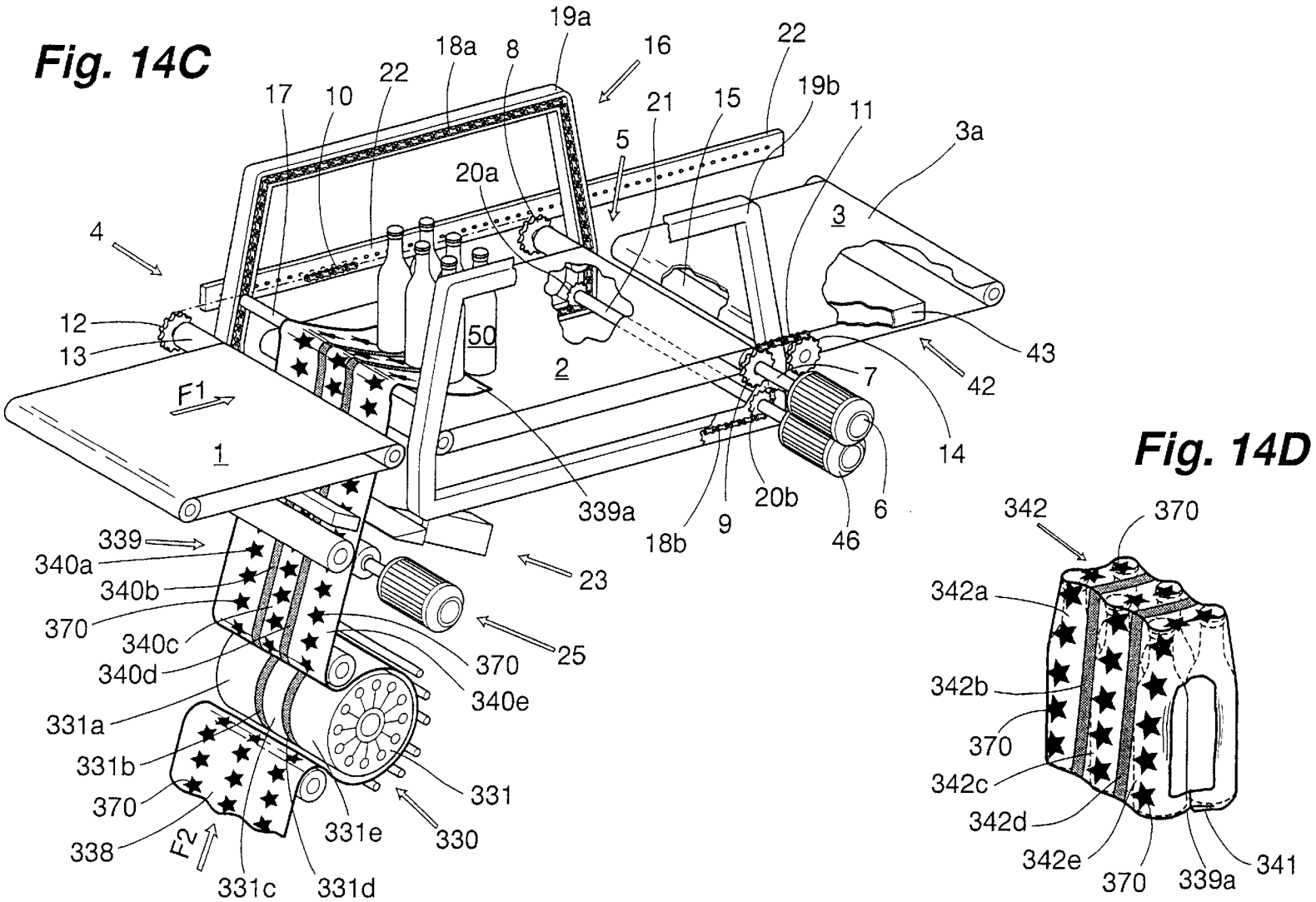

These specific embodiments, see also FIGS. 14*c* and 14*d*, can also advantageously be applied when strips of heat-shrink material which are printed with decorative and/or advertising patterns 370 are used, since it is possible to heat only the areas 340*b* and 340*d*, in which the images are not present, without heating the areas 340*a*, 340*c* and 340*e* in which the said images are present, in order, during cooling, to obtain heat shrinkage only in the said non-printed areas 340*b* and 340*d*, whereas, on the other hand, in the areas 340*a*, 340*c* and 340*e*, in which the printing 370 is present, heat shrinkage, and thus deformation of the said images 370, is avoided.

By this means, the patterns 370 do not undergo deformation by heat shrinkage, and are thus perfectly legible and visually attractive even on the heat-shrunk packaging 342.

Fourth Variant Embodiment—Transverse Strips Heater

Figure 15:
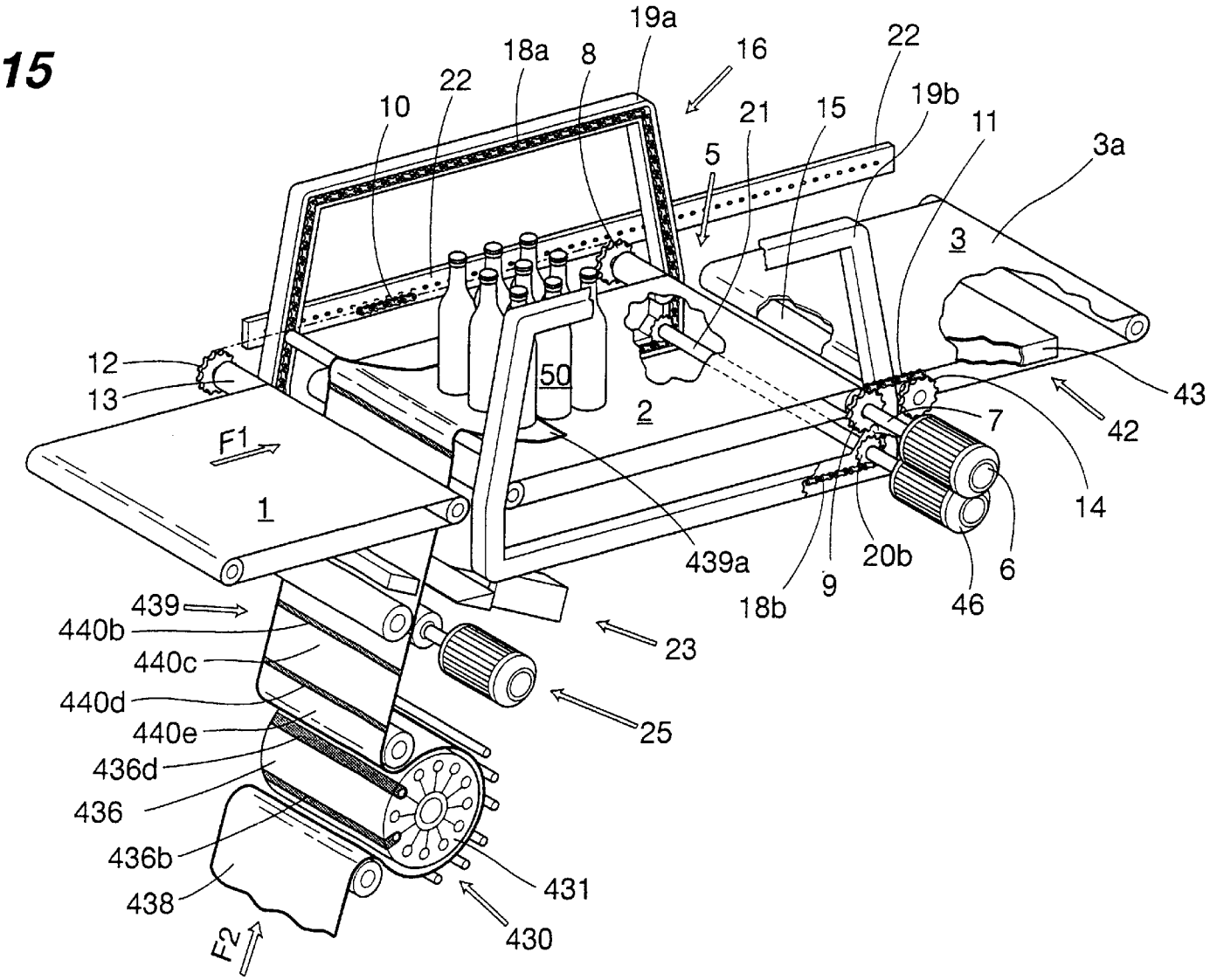
FIGS. 15, 15A, 15B, 15C and 15D are schematic views which are designed to illustrate a further variant of the method and the machine which are the subject of the present invention.
Figure 15A:
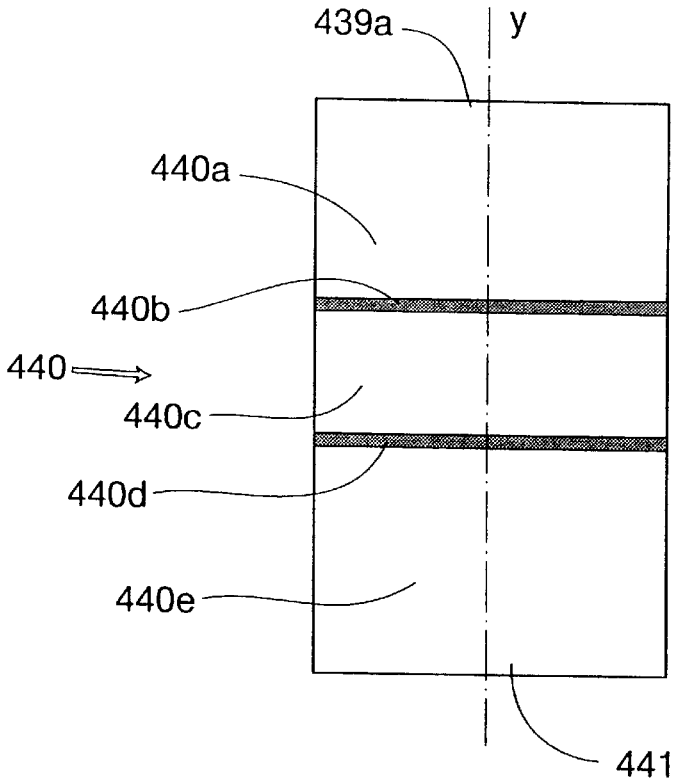
Figure 15B:
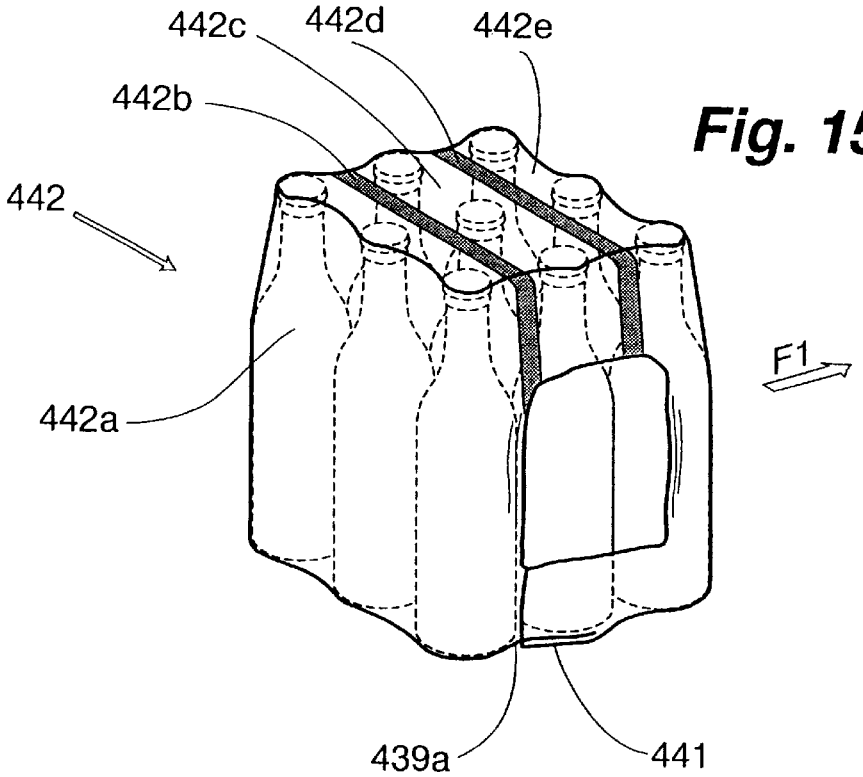
Figures 15C, 15D:
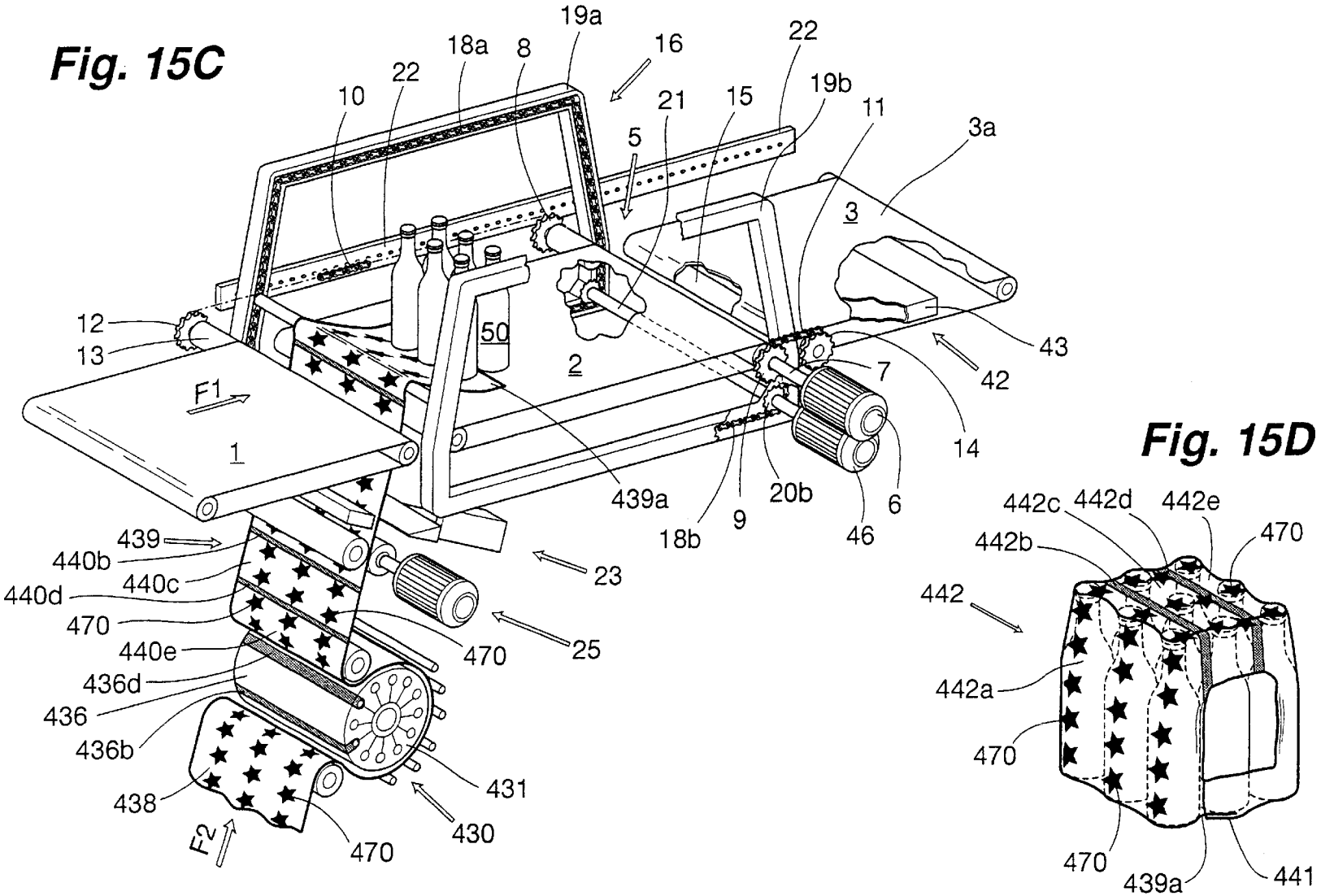

FIGS. 15, 15A and 15B illustrate a different embodiment of the above-described method and machine, which are the subject of the present invention.

Substantially, with reference to this variant, from a heated tape 439 of heat-shrink material, which is heated in a manner described in greater detail hereinafter, there is obtained a sheet 440, which extends along a longitudinal supply and wrapping axis indicated as "Y", which has first transverse strips 440*b*, 440*d* heated to a first, higher temperature, and second transverse strips 440*a*, 440*c* and 440*e* heated to a second, lower temperature:

The said first and second heating temperatures are thus different from one another, but higher than the "defrosting" temperature, such that, after the said heated sheet 440 has been wrapped in the manner of a "sleeve", and is in the correct position around an object, after welding to one another has taken place of the reciprocally overlapping front portion 349*a* and the rear portion 441, and after the said wrapped sheet 440 has been allowed to cool, see in particular FIG. 15B, a heat-shrunk packaging 442 is obtained, which has first transverse strips 442*b* and 442*d*, which correspond to the original first transverse strips 440*b* and 440*d*, and are considerably heat-shrunk, i.e. which have substantial accumulation of material, and second transverse strips 442*a*, 442*c*, 442*e*, which correspond to the original transverse strips 440*a*, 440*c* and 440*e*, and are slightly heat-shrunk, i.e. which have low accumulation of material.

In addition, if required, on the cooled packaging, it is also possible to obtain the said transverse strips 442*a*, 442*c*, 442*e* free from heat-shrinkage, and in this case, according to the operative method, there is no heating of the corresponding transverse strips 440*a*, 440*c*, 440*e* of the sheet 440, or heating of the strips 440*a*, 440*c* and 440*e* to a temperature lower than the so-called "defrosting" temperature.

In order to implement this variant method, by way of example, see FIG. 15, the corresponding machine is provided with different heating means, in this case indicated as 430, which have a specific heating drum, indicated as 431, formed from a cylindrical sleeve 436, in which there are embedded peripherally two transverse bars 436*b* and 436*d*, which are heated in a manner differently from the remainder of the shell, are disposed spaced circumferentially, and thermally insulated, wherein the said bars 436*b* and 436*d* are heated to a higher temperature than the remainder of the shell 436, such that the cold tape 438 wound onto the shell formed by the drum 431 is heated in the above-described differentiated manner.

This particular embodiment, for example, again see FIG. 15B, can advantageously be used in packaging of objects such as bottles or similar products, in which the first transverse strips 440*b* and 440*d*, which are heated more, provided on the tape 439, and thus on the corresponding sheet 440, are correctly spaced longitudinally such as to be disposed on the corresponding batch of bottles in the vicinity of the areas of separation between the transverse rows of the said bottles, in order, after the above-described operations of packaging and heat-shrinkage have taken place, to obtain cooled packaging 442, which in the areas 442*b* and 442*d*, has a greater accumulation of material with considerable retraction, and thus has poor transparency, and, simultaneously, in the areas 442*a*, 442*c* and 442*e*, a lesser accumulation of material, with consequent good transparency.

By this means, the packaging 442 thus obtained has a more pleasing external appearance, and, simultaneously, a potential purchaser who looks at this packaging can distinguish more clearly the bottles it contains, since the said strips 442*a*, 442*c*, 442*e*, i.e. the ones which are more transparent, are disposed against the shafts of the said bottles. In addition, in this context, it should also be noted that any labels applied to the shafts of the bottles, and which are correctly oriented towards the exterior before the packaging takes place, are more intelligible.

These specific embodiments, see also FIGS. 14C and 14D, can also advantageously be applied when strips of heat-shrink material which are printed with decorative and/or advertising patterns 470 are used, since it is possible to heat only the areas 440*b* and 440*d* in which the images are not present, without heating the areas 440*a*, 440*c* and 440*e* in which the said images are present, in order, during cooling, to obtain heat shrinkage only in the said non-printed areas 440*b* and 440*d*, whereas, on the other hand, in the areas 440*a*, 440*c* and 440*e* in which the printing 470 is present, heat-shrinkage, and thus deformation of the said images, is avoided.

By this means, the patterns 470 do not undergo deformation by heat shrinkage, and are thus perfectly legible and attractive, even on the finished, heat-shrunk packaging 442.

With reference to the above-described variants to the method and machine, which are designed to package objects by means of sheets of heat-shrink material heated in a differentiated manner, in general, the operative method used substantially consists in the fact that a sheet of heat-shrink material is used which is heated in a differentiated manner, in which some areas of the said sheet are heated at a different temperature from other areas of the same sheet, in which the arrangement of the said areas on the said sheet is determined in relation to the position which the areas themselves assume relative to the object to be packaged, when the said sheet, thus heated, is correctly wrapped round the object to be packaged, in order then to be able to wrap in a correct position this sheet of heat-shrink material heated in a differentiated manner around the object to be packaged in the manner of a sleeve, with a front portion and a rear portion of the said sheet overlapping one another, to weld the said front portion and the said rear portion of the sheet to one another, and to allow the assembly obtained to cool, until different percentages of heat shrinkage are obtained amongst the said areas previously heated in predetermined areas of the packaging.

The preceding description of the operative method and of the machine, as well as the descriptions provided of all the variants of methods and machines, are provided purely by way of non-limiting example, and it is thus apparent that there can be made to these methods and machines any changes and/or variants suggested by practice and by their utilisation or use, within the context of the scope of the following claims.

What is claimed is:

1. A machine for packaging objects by wrapping heat-shrink material around the objects and shrinking the sheets onto the objects, said machine comprising;

first conveyor means disposed at an upstream location along a path for supplying the objects longitudinally in a transport plane;

second conveyor means downstream of said first conveyor means along said path and spaced from said first conveyor by a first aperture for receiving the objects from said first conveyor means and displacing the objects longitudinally along a wrapping plane, having an intake end and an output end;

third conveyor means downstream of said second conveyor means along said path and spaced from said second conveyor means by a second aperture to receive the objects from said second conveyor means and displace the objects along said path away from the second conveyor means;

wrapping means along said second conveyor means including suspended wrapping bars oriented transversely relative to a direction of advance of the objects and displaceable through said first aperture and second aperture, along an orbital path which circumscribes said second conveyor means for transporting the heat-shrink material around the objects to be packaged;

supply means disposed beneath and aligned with said first aperture for supplying a tape of said heat-shrink material;

cutting means disposed between the supply means and said first aperture for cutting the tape transversely;

synchronizing means for synchronizing said conveyors and said wrapping, supply and cutting means with one another; and heating means disposed upstream of said supply means along said tape for heating a cold tape to a temperature which is at least equivalent to a defrosting temperature of the tape before said tape reaches said supply means whereby said supply means withdraws heated tape from said heating means and feeds heated tape to said wrapping means.

2. The machine defined in claim 1 wherein said heating means comprises a heating drum upstream of said supply means and rotating on a shaft disposed transversely relative to the direction of advance of the tape and onto which the cold tape of heat-shrink materials is wound.

3. The machine defined in claim 2 wherein said heating drum comprises a plurality of resistance heaters disposed in axial holes spaced circumferentially in a vicinity of a circumference of the drum.

4. The machine defined in claim 3, further comprising regulating means for regulating the temperature of said resistance heaters and thus the temperature of the circumference of the heating drum.

5. The machine defined in claim 3, wherein said resistance heaters are supplied by sliding contacts disposed on sides of the drum to supply power in said heaters while the drum is rotating.

6. The machine defined in claim 2 wherein said heating means includes a plurality of pressure rollers pressing the cold tape against a circumference of the drum.

7. The machine defined in claim 6 wherein the pressure rollers are hot.

8. The machine defined in claim 2 wherein the heating means comprise:

a first return roller disposed upstream from the heating drum and around which the cold tape passes; and a second return roller disposed downstream from the heating drum and around which the heated tape passes.

9. The machine defined in claim 8 wherein said first return roller is hot.

10. The machine defined in claim 8 wherein said second return roller is hot.

11. The machine defined in claim 2 wherein said heating drum has a shell formed by areas at different temperatures to heat the tape of heat-shrink material in a differential manner.

12. The machine defined in claim 2 wherein said heating drum consists of a plurality of rollers at different temperatures and adjacent one another axially.

13. The machine defined in claim 2 wherein said heating drum has a plurality of bars which are provided with different temperatures are oriented transversely, and are embedded in a shell of said drum.

14. The machine defined in claim 1 wherein said supply means and said heating means have respective rollers, the peripheral speed of rollers of the supply means being greater than the peripheral speed of the roller of the heating means to stretch the heated tape longitudinally.

15. The machine defined in claim 1, further comprising regulating means for regulating the temperature of said heating means.

16. The machine defined in claim 1, further comprising transverse stretching means disposed between the supply means and the heating means.

17. The machine defined in claim 1 where said heating means comprises thermal irradiation means.

18. The machine defined in claim 17 where said thermal irradiation means are disposed upstream from the said supply means.

19. The machine defined in claim 18 where said thermal irradiation means comprises two supports which are hollow internally and which have a transverse length equivalent to that of the cold tape in which said supports support respective pluralities of irradiating lamps which are disposed facing one another and between which the cold tape moves freely.

20. The machine defined in claim 19 wherein said pluralities of irradiating lamps are infra-red lamps.

21. The machine defined in claim 1 wherein said heating means comprise thermal convection means.

22. The machine defined in claim 21 wherein said thermal convection means are disposed upstream from the said supply means.

23. The machine defined in claim 22 wherein said thermal convection means comprise two cases which are hollow internally with a transverse cross-section in the shape of a "C", said two cases being disposed facing one another and have a width equivalent to that of the cold tape, in which an air heater is provided in order to create forced circulation of hot air inside the chambers of the said two cases, the cold tape moving freely between the said two hollow cases.

* * * * *